US005839587A

United States Patent [19]

Gress et al.

[11] Patent Number: 5,839,587

[45] Date of Patent: Nov. 24, 1998

[54] LENS DISPLAY SYSTEM

[75] Inventors: Gary Robert Gress, Don Mills; Lindsay James Lummiss, Scarborough, both of Canada

[73] Assignee: CDA Industries Inc., Scarborough, Canada

[21] Appl. No.: 833,130

[22] Filed: Apr. 4, 1997

[51] Int. Cl.[6] ..... A47F 5/00

[52] U.S. Cl. ..... 211/59.2; 211/187; 211/188; 211/49.1

[58] Field of Search ..... 211/59.2, 49.1, 211/186, 187, 188, 194, 135

[56] References Cited

U.S. PATENT DOCUMENTS

| | | | |
|---|---|---|---|
| 1,662,637 | 3/1928 | Chase | 211/59.2 |
| 1,745,784 | 2/1930 | Davis | 211/59.2 X |
| 2,781,918 | 2/1957 | Palm | 211/59.2 X |
| 2,905,330 | 9/1959 | Lilja | 211/59.2 |
| 3,549,019 | 12/1970 | Wood et al. | 211/186 X |
| 4,416,380 | 11/1983 | Flum | 211/194 X |
| 4,925,038 | 5/1990 | Gajewski | 211/59.2 |
| 5,392,902 | 2/1995 | Vlastakis | 211/135 |
| 5,421,467 | 6/1995 | Dittborn | 211/188 X |
| 5,636,752 | 6/1997 | Gallagher | 211/41.12 |
| 5,702,011 | 12/1997 | Carroll | 211/135 |

*Primary Examiner*—Robert W. Gibson, Jr.

[57] ABSTRACT

A lens display assembly, which has left and right hand end members which can be supported generally upright, interlock attachments on inwardly facing surfaces of the end members in registration with one another, and spaced axially apart, transverse shelves extending between the end members, and interlock parts at opposite ends of the shelves, interlockable with the interlock attachments on the end members, so that the shelves can be supported transversely between the end members and, lens display supports on the shelves, for supporting lenses.

11 Claims, 9 Drawing Sheets

FIG. 12
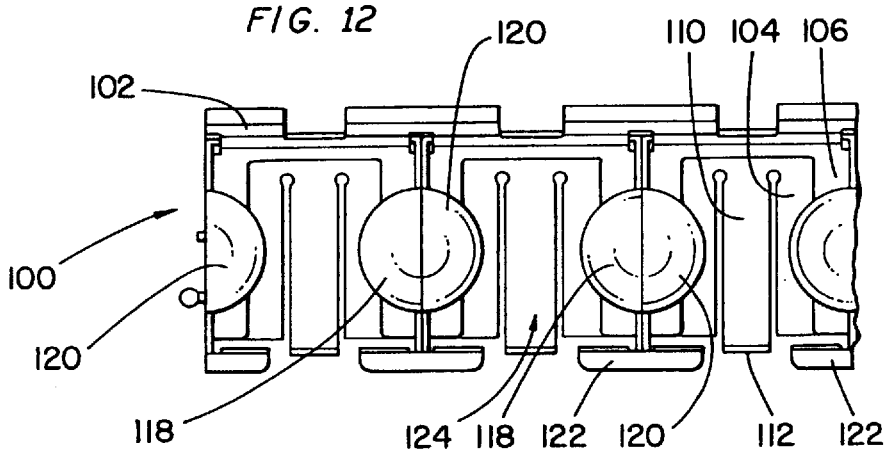
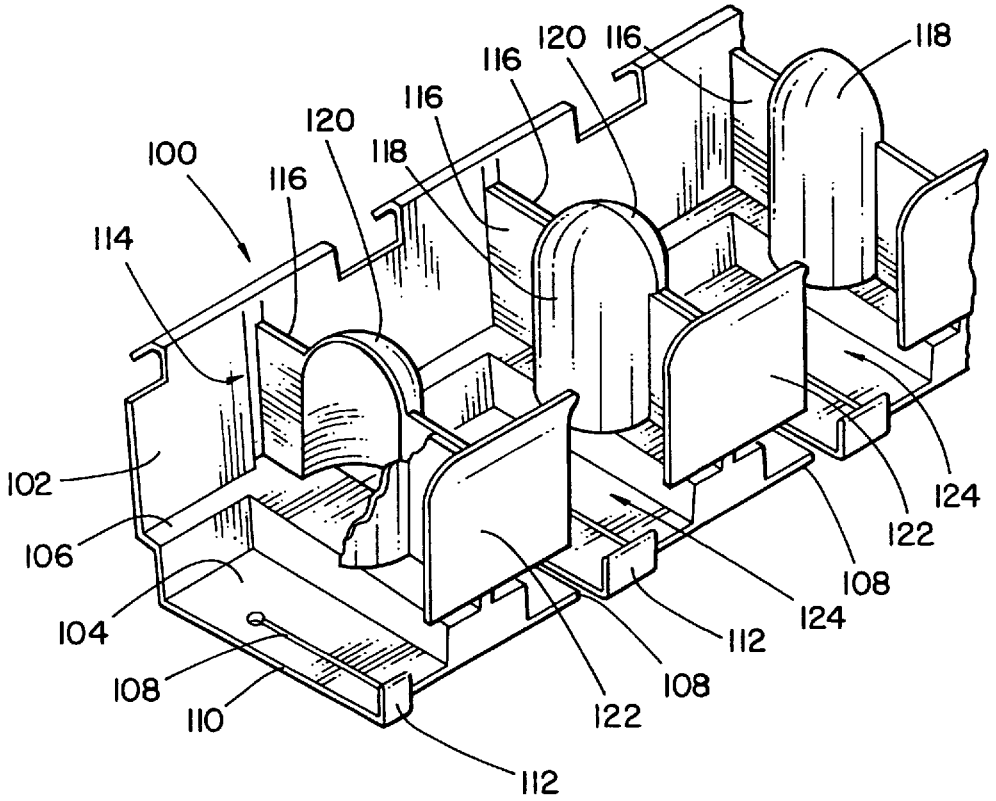
FIG. 13

LENS DISPLAY SYSTEM

FIELD OF THE INVENTION

The invention relates to a display system for contact lenses, such as are used by persons, in place of spectacles.

BACKGROUND OF THE INVENTION

Such contact lenses are produced in a very wide range of sizes and shapes, to fit persons with different sized eye cavities. They are also produced in a very wide range of focusing ability and magnification and correction of astigmatism, to accommodate persons with a wide range of requirements for eye correction.

As a result, oculists and optometrists stocking such lenses must provide a very large range of drawers or shelves on which various sizes and shapes of lenses can be stored. All of these shelves or drawers must be carefully labelled.

Such storage and display arrangements may vary from one store to another, since they are largely custom made, and as a result, the storage and display of such contact lenses is not always easy for a customer to see and appreciate, and is also sometimes confusing for the retailers.

Clearly, it is desirable to provide a uniform storage and display system. This will enable customers to see all of the different lenses that are available, possibly trying out several different shapes, before making a selection. It will also enable the retailer to more readily pick out the lenses which the retailer feels are most likely to satisfy the requirements of the customer.

In addition to the foregoing, the construction and design of such display systems, on a custom basis is expensive and not always satisfactory. Clearly it is desirable to provide a more or less uniform modular display system, which can be sold by the supplier of the lenses, and can be shipped in a knocked down condition to save space and which can be assembled and installed in the store. Preferably the display will incorporate the names and code numbers of the manufacturer of the lenses, thereby still further facilitating the display and selection of such lenses in a store.

BRIEF SUMMARY OF THE INVENTION

With a view to achieving the foregoing general objectives the invention comprises a lens display assembly, which in turn comprises left and right hand end members, support means on said end members for supporting said end members generally upright, interlock attachment means on inwardly facing surfaces of said end members in registration with one another, and spaced axially apart along the length of said end members by equal spacings, transverse shelf members adapted and shaped to extend between said end members, and interlock securing means formed at opposite ends of said shelf members, interlockable with said interlock formations on said end members, whereby said shelf members can be supported transversely between said end members and with said shelf members in spaced apart relation, and, lens display supports on said shelf members, for supporting lenses along the length of said shelf members.

It is a further objective of the invention to provide, support leg members attachable to said end members, at lower ends thereof, and adapted to support said end members at an inclined angle when said leg members are standing on a level surface.

The invention further envisages the use of interconnection members formed at the upper and lower ends of said end members, whereby two or more such end members can be interconnected end to end to make a lens display assembly of greater height.

The invention also provides a sliding lens drawer systems, in which lenses may be stacked safely, and when one lens is withdrawn, another lens drops down into display position.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

FIG. 12 is a schematic side elevational view corresponding to FIG. 11, showing another arrangement of shelving units;

FIG. 13 is a top plan view of another embodiment of shelving unit for displaying individual lenses.

DESCRIPTION OF A SPECIFIC EMBODIMENT

Figure 1:
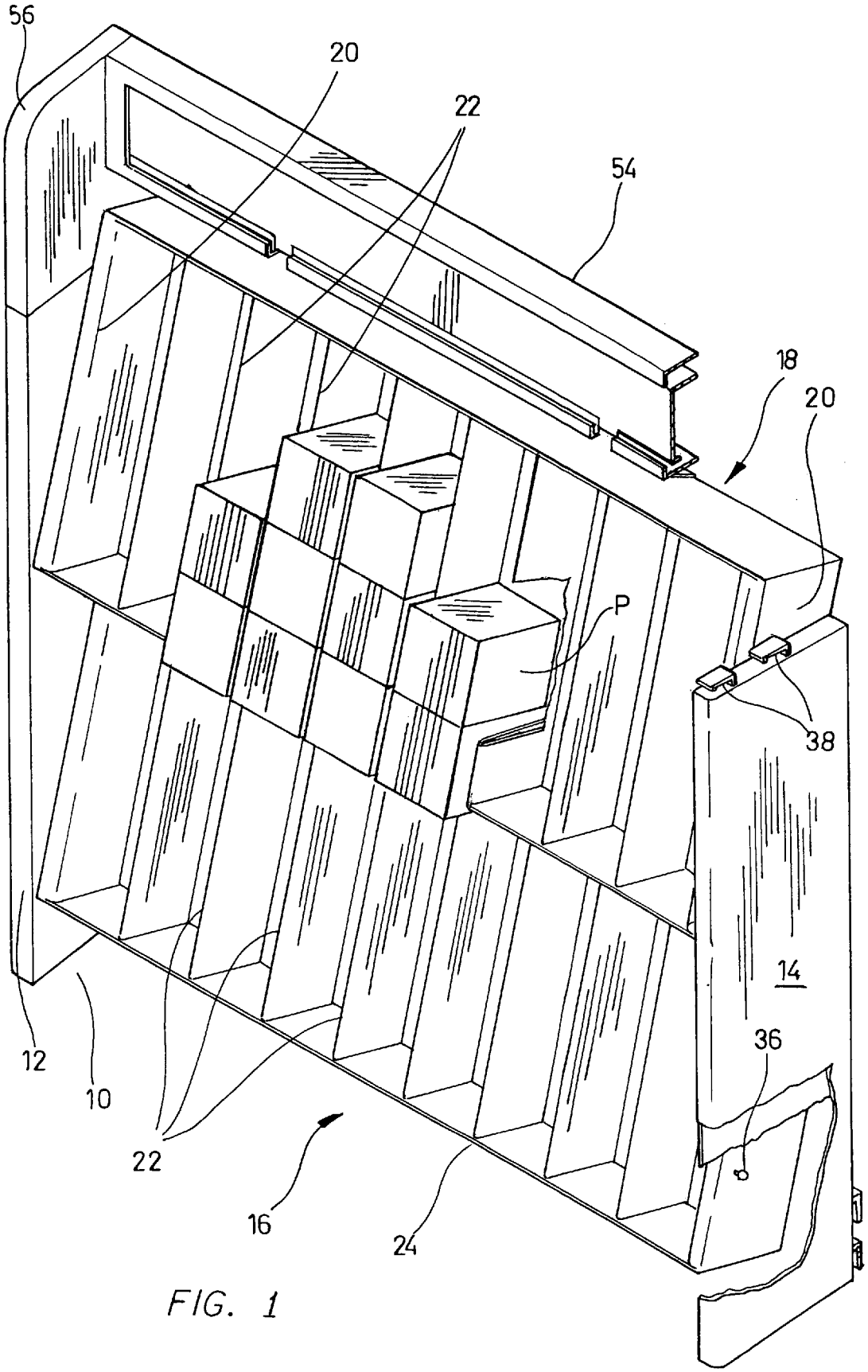
FIG. 1 is a perspective illustration partially cut away of a single lens display system, showing lenses stacked in rectangular boxes.

Referring first of all to FIG. 1, it will be seen that the invention is there illustrated in the form of a lens display cabinet indicated generally as 10. The cabinet 10 in this embodiment comprises two vertical side members 12 and 14, which are right and left hand mirror images of one another.

Shelving units 16 and 18 extend transversely between the side members 12 and 14 and are attached thereto in a manner to be described below.

In this embodiment, the shelf members consist simply of spaced apart end walls 20—20, and intermediate vertical partition walls 22—22. The walls 22—22 define a series of equally spaced apart vertical compartments.

Each shelving unit 16 and 18 is completed by respective bottom and top walls 24 and 26 and rear walls.

The spacing between the vertical partitions 22 is such that it is designed to receive rectangular packages indicated generally as P, containing contact lenses. The packages will be printed with suitable information regarding the type and characteristics of the lenses, so that the appropriate lenses can be easily selected by simply removing the appropriate box from its respective compartment between any two partitions 22.

While, for the sake of simplicity, the illustration shows only a few such packages P in this drawing, it will be appreciated that in most cases the shelving unit 16 and 18 will be substantially filled with packages P.

Figure 2:
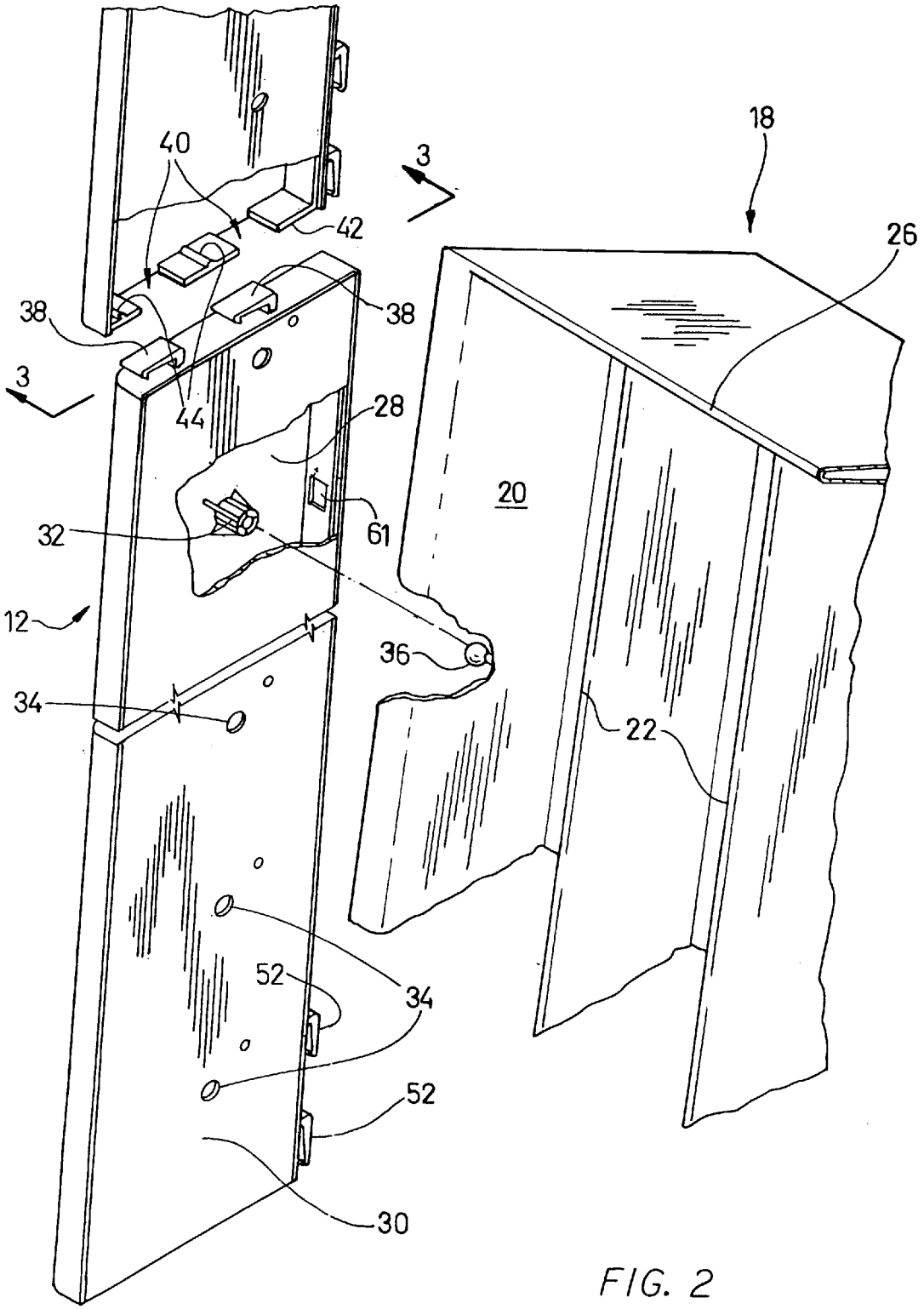
FIG. 2 is an exploded perspective view of a portion of the display of FIG. 1, showing the attachment between the side members and the shelving units.

As explained above, the side members 12 and 14 are detachably attachable to the shelving units 16 and 18, by means illustrated in FIG. 2. For the purpose of this explanation it will be understood that each of the side members 12–14 is of hollow construction, consisting of outer side walls 28—28 and inner side walls 30—30. The outer side walls 28 are formed on their interior, at vertically spaced intervals, with locking sockets 32. The locking sockets 32 register with pin openings 34, formed on the inner side walls 30.

The shelving units 16–18 and so on are provided on respective opposite side walls 20—20 with outwardly projecting abutments 36. The abutments terminate in generally spherical locking members, which are sized and adapted to pass through the openings 34 in the inner walls of side members 12–14, and to register with and enter into locking sockets 32.

In this way, the side member 12 and 14 can be locked securely in engagement with the shelving units 16–18, so as to provide a substantially rigid display unit.

At the same time, with a little bit of leverage and force, the shelving units can be dismantled once more if required.

Figure 3:
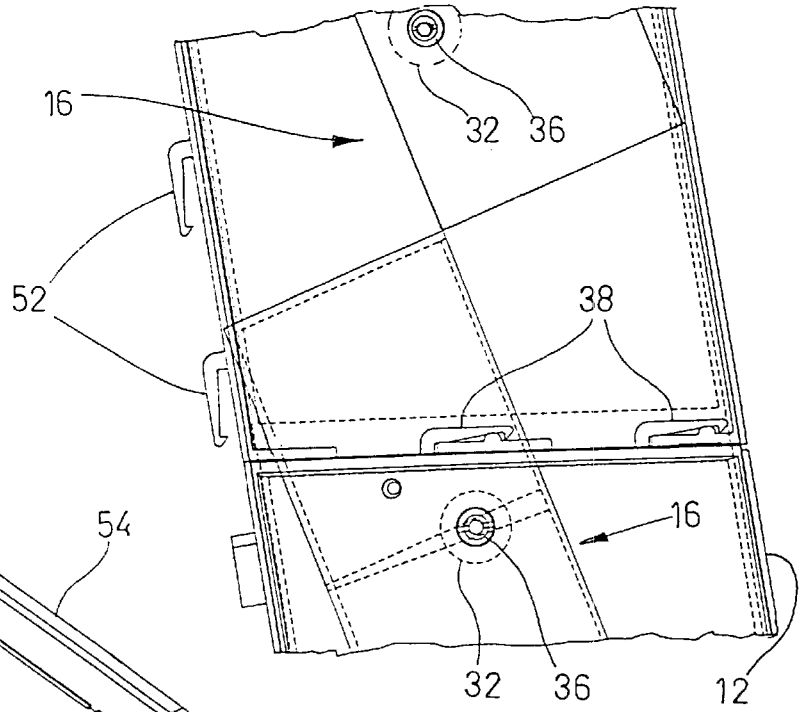
FIG. 3 is a sectional illustration along the line 33 of FIG. 2, showing the connection between lower and upper side members.

It is also a feature of the invention that the side walls 12–14 may be connected end for end, one above the other, to make a two or even three storey display unit. As illustrated in FIGS. 2 and 3, the upper ends of side members 12 and 14 are provided with generally L-shaped locking flanges 38.

The lower ends of side members 12 and 14 are provided with openings 40—40 in lower wall 42, and interlocking ridges 44 are provided, for interengaging with the L-shaped locking flanges 38 (see FIG. 3).

Figure 4:
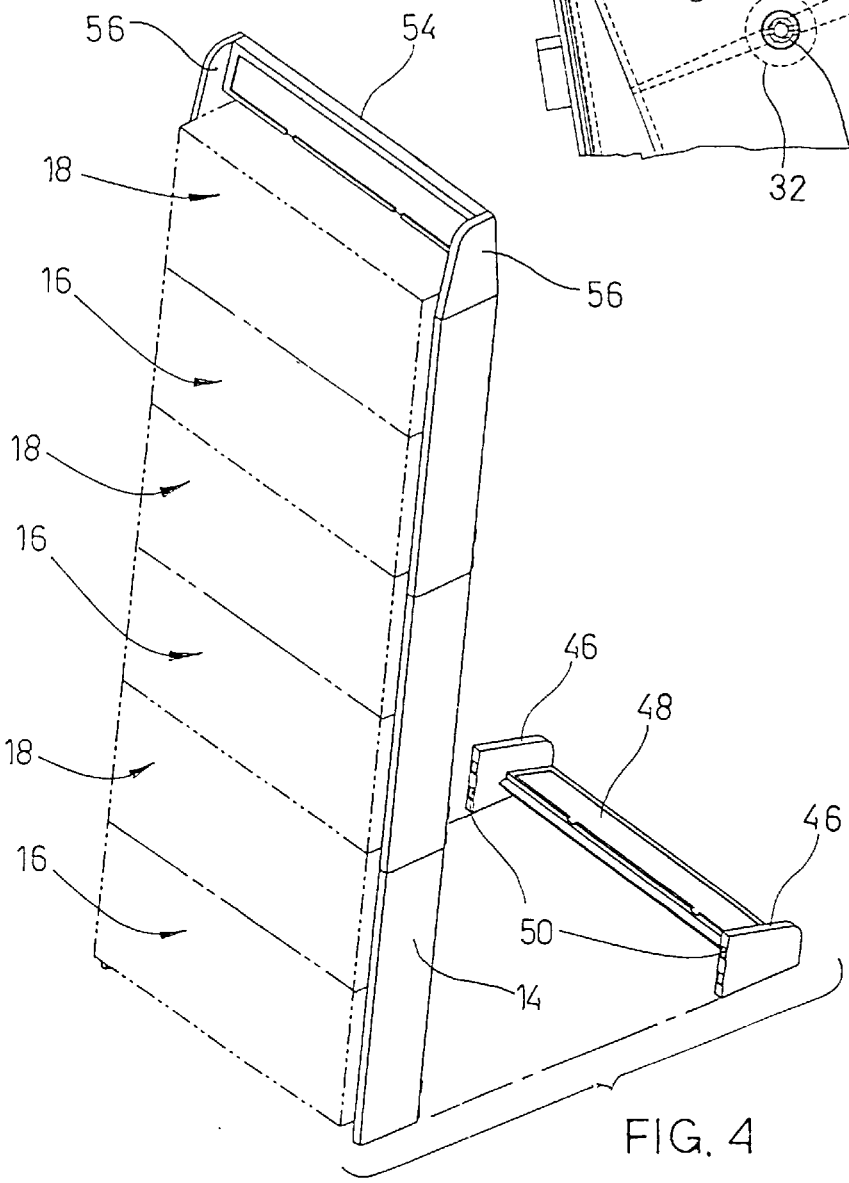
FIG. 4 is a perspective illustration partially in phantom, showing three sets of display units stacked one above the other, and showing a support leg in exploded form.
Figure 5:
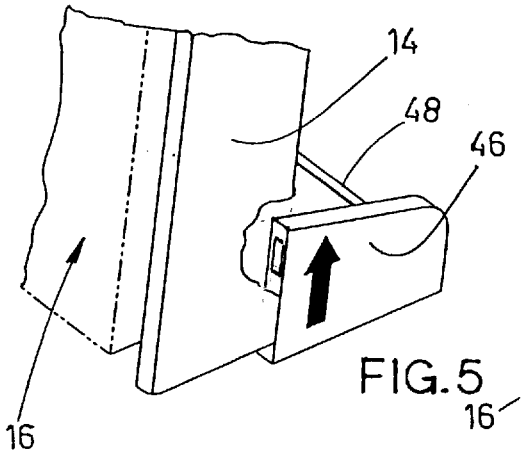
FIG. 5 is a fragmentary perspective of FIG. 4 showing the movement for the attachment of the support leg.
Figure 6:
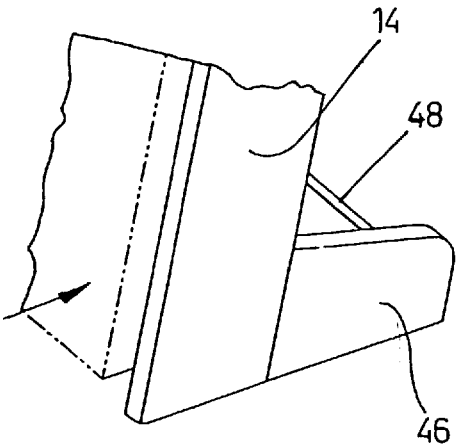
FIG. 6 is a fragmentary perspective corresponding to FIG. 5 showing the support leg seated in position.

As illustrated in FIGS. 4, 5 and 6, the display units may be made free standing on the floor. For this purpose rear leg members 46—46 are provided, connected by cross-members 48.

The leg members 46 are provided with flange receiving locking recesses 50 and at the lower ends of the rearward edge of the side members 12 and 14, generally L-shaped locking flanges 52 are provided registering with the openings 50, so that the legs 46 may be snap fitted and locked onto the rearward lower ends of the side members 12 and 14.

To finish off the display, a top panel 54 is supported between two end brackets 56—56. The end brackets 56 are similarly provided with openings (not shown) interfitting with L-shaped flanges 38 at the upper ends of side members 12 and 14.

Comparing the end brackets 56—56, and the top panel 54, it will be seen that they are interchangeable with the rear leg members 46—46 and cross members 48, thereby economizing in tooling cost and inventory.

Figure 7:
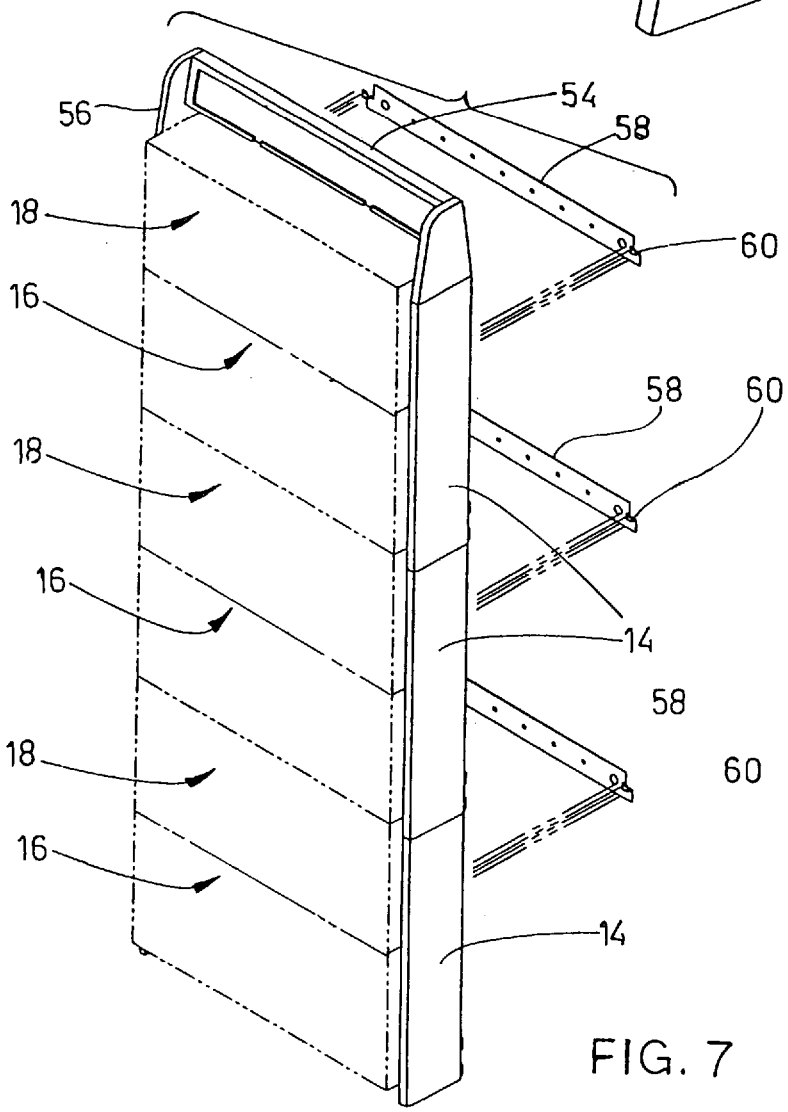
FIG. 7 is a perspective with parts shown in phantom, showing a means of wall attachment for the display unit if it is desired to attach it to a vertical wall.

On the other hand if desired, the entire display unit can be mounted on a wall, as illustrated generally in FIG. 7.

In this case, a plurality of wall suspension strips 58 are provided, having end tabs 60 struck out. The strips 58 may be secured to the wall at spaced intervals. The entire display unit may then simply be engaged on the struck out tabs 60, which extend into rectangular openings 61 in rear faces of side members 12 and 14 holding the entire display flat against the wall.

Figure 8:
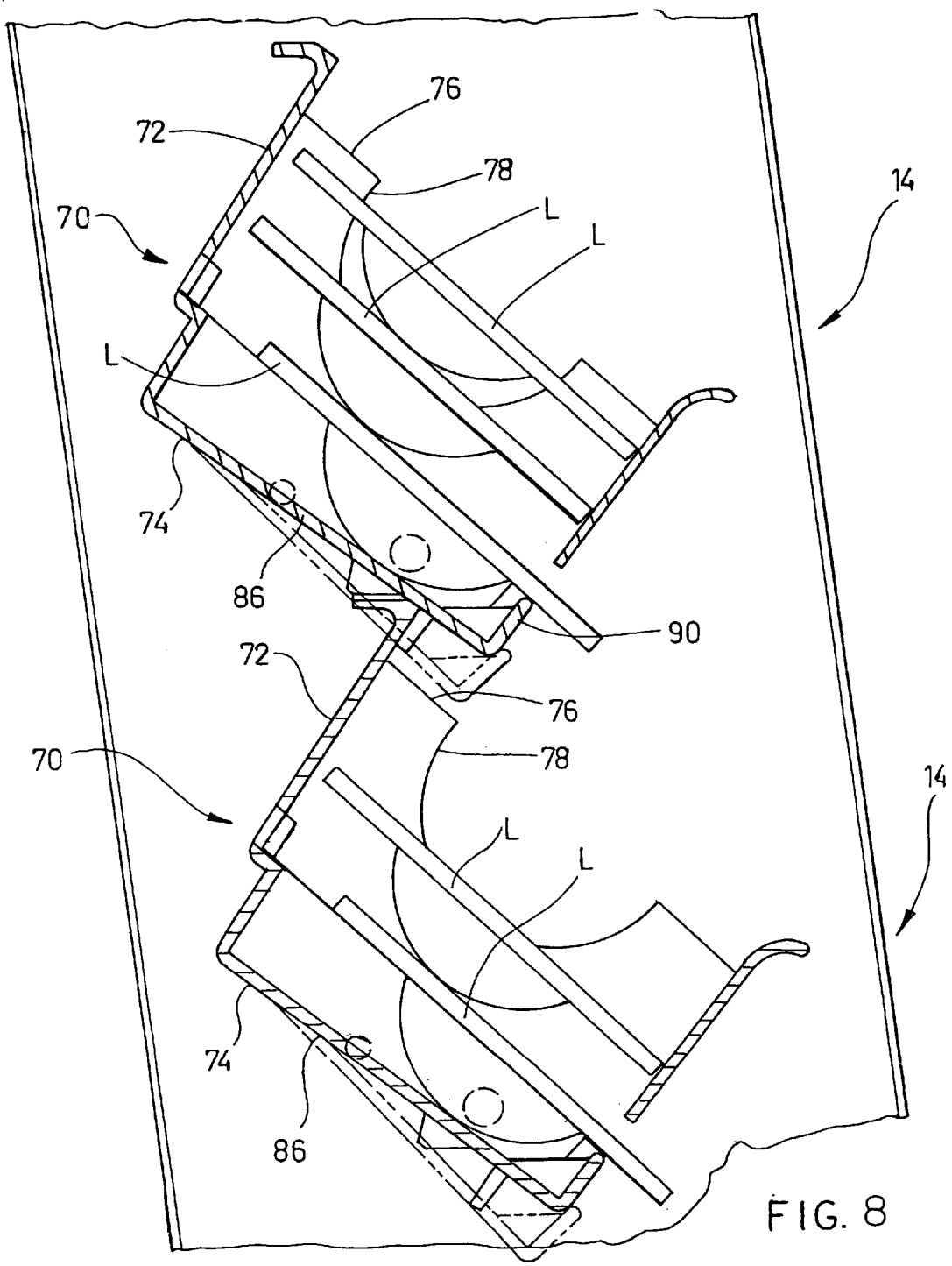
FIG. 8 is a sectional side elevation of an alternate embodiment of shelving units, for display of individual lenses, taken along the line 8—8 of FIG. 9.
Figure 9:
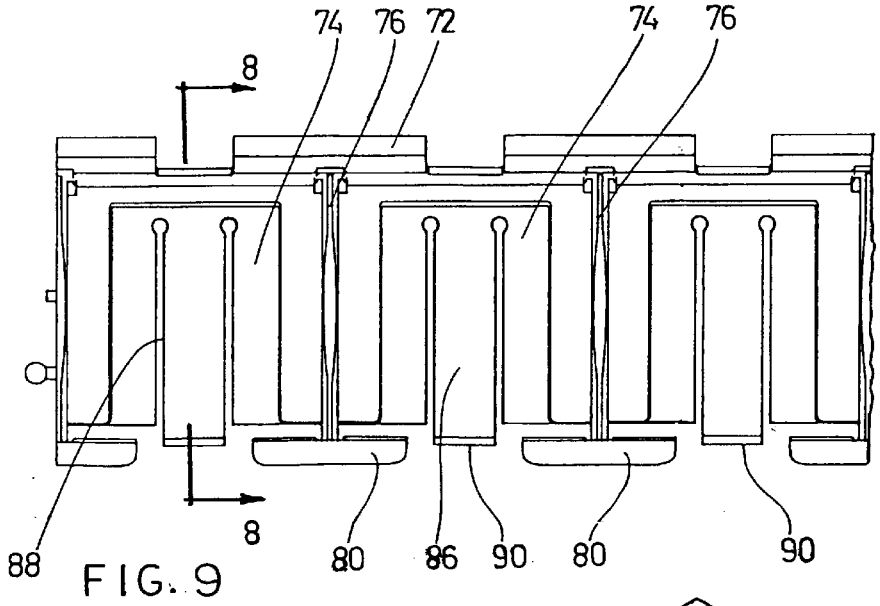
FIG. 9 is a top plan view of the embodiment of FIG. 8, shown partially cut away at one end.
Figure 10:
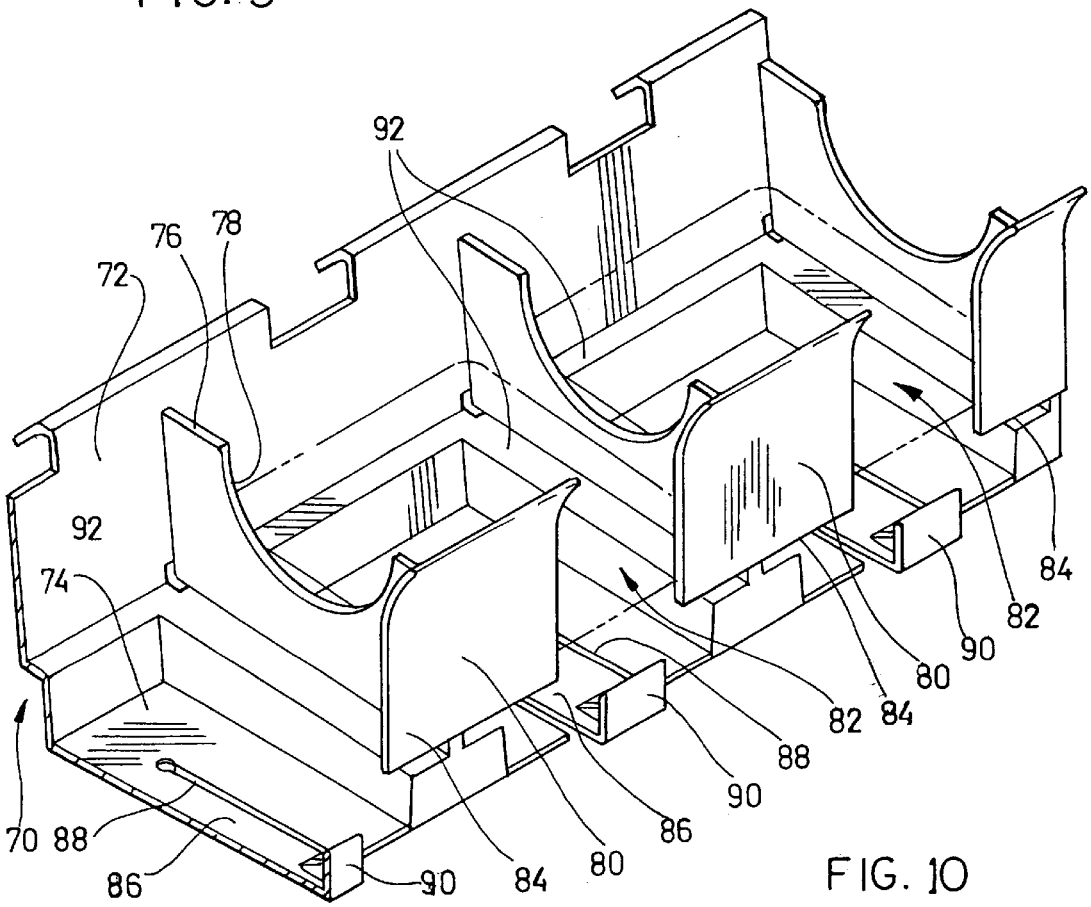
FIG. 10 is a partial perspective view of the embodiments of FIGS. 8 and 9.

Referring now to FIGS. 8, 9 and 10, it will be seen that a modified shelf unit is illustrated there as 70. These modified shelf units are designed to hold individual lens packages indicated as L.

In order to support the lens packages in this way, the shelving units 70 comprise a continuous back wall 72, and a continuous bottom wall 74.

Transverse partition walls 76 extend forwardly from the back wall 72 at spaced intervals, preferably being formed with recesses 78 for ease of handling of the lenses.

The partition walls 76 extend forwardly and terminate at front spacer walls 80. Spacer walls 80 are formed in a t-shaped manner on the forwardly extending edges of partition walls 76, and are discontinuous and define spaces 82 therebetween.

The lower edges of the spacer walls 80 terminate above the bottom walls 74, as at 84.

A flexible lens retaining arm 86 is defined by parallel slots 88, in bottom walls 74.

A generally l-shaped upstanding front flange 90 holds the lowermost lens package L in position, and prevents it from sliding out.

The lowermost lens package L can be slid out as shown in FIG. 8 by simply sliding the lens package L forwardly so that it simply slides over the flange 90 on arm 86.

In order to support the lower most lens package L, generally three-sided rectangular shoulder walls 92 are formed around the perimeter of bottom wall 74, preventing the lower most lens package L from dropping to the bottom wall 74.

Figure 11:
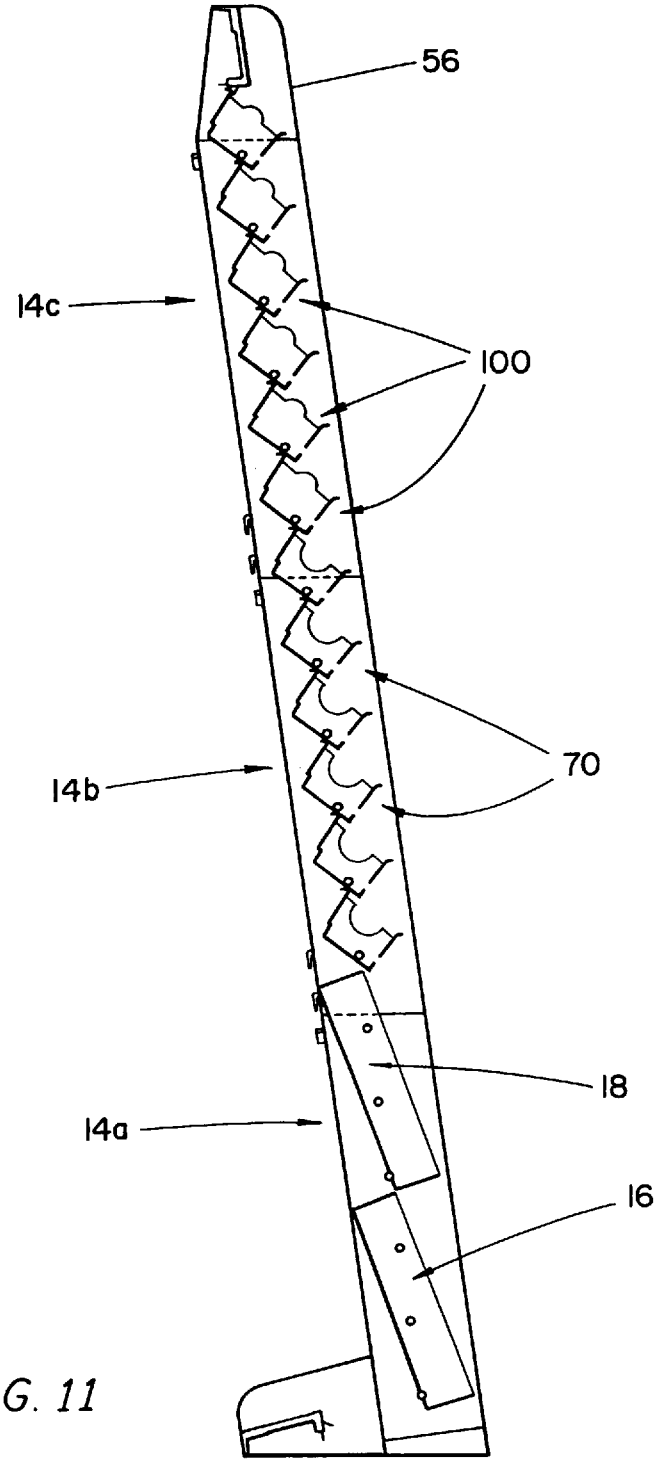
FIG. 11 is a schematic side elevation of one arrangement of the display illustrating the invention, showing one arrangement of shelving units.

The invention may be assembled in a variety of different configurations. As shown in FIG. 11, a three-tier configuration may be arranged, similar to that shown in FIGS. 4 and 7.

In the multiple embodiment of FIG. 11, there are shown three sets of side walls 14A, 14B and 14C mounted one above the other. Rearward legs 46 attach to the lower-most sidewalls 14A supporting the entire structure, and top members 56 finish off the top end of the top most set of side walls 14C.

Within the lower most pair of sidewalls 14A, there are supported standard vertical column shelving units 16 and 18, as shown in FIG. 1.

Within the second set of sidewalls 14B, there are shown transverse lens shelves 70—70 corresponding to FIGS. 8, 9 and 10.

Figure 14:
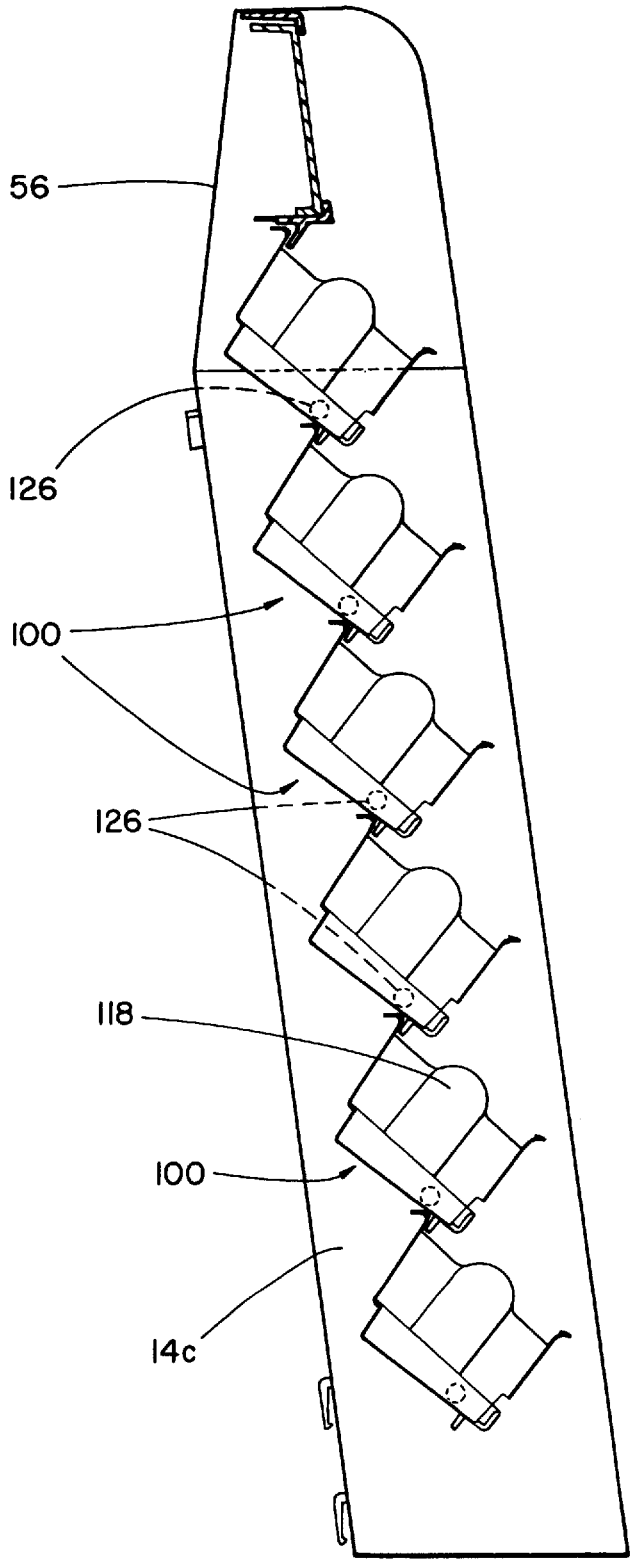
FIG. 14 is a perspective illustration of a portion of a shelving unit illustrating the embodiment of FIG. 13.

Within the upper most pair of sidewalls 14C, there is shown further modified form of lens shelves indicated generally as 100. The lens shelves 100 are illustrated in more detail in FIGS. 12, 13 and 14.

Each of the shelves 100 will be seen to consist of a continuous backwall 102, and an integral bottom wall 104. Bottom wall 104 is surrounded by a generally angular shoulder 106, on three sides thereof.

Located more or less centrally of the bottom wall 104, are two elongated slots 108, parallel with one another, which define a flexible tongue 110.

Flexible tongue 110 terminates in an upstanding L-shaped stop member 112.

Extending forwardly at spaced intervals from the backwall 102, are respective partition walls 114. Each of the partition walls 114 are formed with respective insert side panels 116 having matching generally semi-circular domed formations 118 and 120. The two semi-circular dome shaped structures mate with one another, to form generally cylindrical bodies with dome shaped tops, as shown in FIGS. 12 and 13. They may be inserted or removed as desired.

Located at the forward ends of the walls 114, are retaining plates 122. The plates 122 are discontinuous, and define spaces 124 therebetween.

The opposite ends of the shelves 100 are formed with interlocking abutments, similar to the abutments 36 of the embodiment of FIG. 2.

This embodiment 100 of shelf is used for displaying lenses, packaged in a generally hour-glass shaped package (not shown), which is designed to fit around the cylindrical bodies 118 and 120. Such packages may be withdrawn one at a time by more or less in the same way as in the embodiment of FIGS. 8, 9 and 10.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A lens display assembly, which in turn comprises;

left and right hand end members having inwardly and outwardly facing surfaces;

support means on said end members for supporting said end members generally upright;

interlock attachment means on said inwardly facing surfaces of said end members in alignment with one another, and spaced axially apart along the length of said end members by equal spacings;

transverse shelf members adapted and shaped to extend between said end members;

interlock securing means formed at opposite ends of said shelf members, interlockable with said interlock attachment means on said end members, whereby said shelf members can be supported transversely between said end members and with said shelf members in spaced apart relation;

lens display supports on said shelf members, for supporting lenses along the length of said shelf members; and, support leg members attachable to said end members, at lower ends thereof, and adapted to support said end members at an inclined angle when said leg members are standing on a level surface.

2. A lens display assembly as claimed in claim 1 and including interconnection members formed at the upper and lower ends of said end members, whereby two or more such end members can be interconnected end to end to make a lens display assembly of greater height.

3. A lens display assembly as claimed in claim 1 and including sliding lens stacking systems, in which lenses may be stacked for display, and when a lower lens is withdrawn, another lens drops down into a dispensing position.

4. A lens display assembly as claimed in claim 1 wherein said end members comprise inner end walls and outer end walls, and edge walls extending there between, whereby to define a generally hollow end wall structure.

5. A lens display assembly as claimed in claim 4 wherein said walls define interior surfaces and wherein said interlock attachment means are formed on said interior surfaces of said walls, and including opening means in said end members for access to said attachment means.

6. A lens display assembly as claimed in claim 5 wherein said interlock securing means comprise socket members extending outwardly from opposite ends of said shelf members, and adapted to pass through said opening means for interengagement with said interlock attachment means.

7. A lens display assembly as claimed in claim 2 wherein said interconnection members comprise opening means formed at spaced intervals in said edge walls of said end members, and interlock flanges formed on said edge walls adapted to enter said opening means, and interconnect therewith.

8. A lens display as claimed in claim 1 wherein said shelf means comprises a back wall, and a lower wall extending continuously from one end member to the other, and a plurality of partition walls extending normal to said back wall and said bottom wall at spaced intervals, defining separate compartments for reception of lens packages therein.

9. A lens display assembly as claimed in claim 8 wherein said bottom walls of said shelves define generally parallel slots, and flexible tongue means formed between said slots, and retaining flanges on the forward ends of said tongues, whereby said tongues and said flanges may retain the lower most lens package within each said compartment of said shelf means.

10. A lens display assembly as claimed in claim 9 and including generally right-angular ledge means formed around said back wall and said partitions, defining a lower limit for positioning of said lens packages therein.

11. A lens display assembly as claimed in claim 10 including generally semi-cylindrical formations adapted to be attached to said partition, said semi-cylindrical formations extending upwardly and terminating in generally dome shaped formations, for retaining lens packages in said partitions.

* * * * *